US008517809B2

(12) United States Patent
Wexler

(10) Patent No.: US 8,517,809 B2
(45) Date of Patent: Aug. 27, 2013

(54) LOUVER CLOSURE SYSTEM AND METHOD

(75) Inventor: Elias Wexler, Scarsdale, NY (US)

(73) Assignee: Zero International, Inc., Bronx, NY (US)

( * ) Notice: Subject to any disclaimer, the term of this patent is extended or adjusted under 35 U.S.C. 154(b) by 2010 days.

(21) Appl. No.: 11/401,913

(22) Filed: Apr. 12, 2006

(65) Prior Publication Data

US 2007/0251175 A1 Nov. 1, 2007

(51) Int. Cl.
*E06B 7/082* (2006.01)

(52) U.S. Cl.
USPC ..... 454/277

(58) Field of Classification Search
USPC ..... 454/277
See application file for complete search history.

(56) References Cited

U.S. PATENT DOCUMENTS

| | | | | |
|---|---|---|---|---|
| 1,784,841 | A * | 12/1930 | Landau | 454/195 |
| 4,442,157 | A | 4/1984 | Marx et al. | 428/173 |
| 4,914,880 | A | 4/1990 | Albertini | 52/243 |
| 6,130,381 | A | 10/2000 | Keith et al. | 174/17 VA |
| 6,548,753 | B1 | 4/2003 | Blackmon et al. | 174/50 |
| 6,643,991 | B1 | 11/2003 | Moyes | 52/784.11 |
| 6,745,526 | B1 | 6/2004 | Autovino | 52/232 |
| 6,752,714 | B1 | 6/2004 | Mann | 454/369 |
| 6,831,842 | B1 | 12/2004 | Mendoza et al. | 361/796 |
| 6,848,227 | B2 | 2/2005 | Whitty | 52/232 |
| 2005/0045356 | A1 * | 3/2005 | Valenziano | 174/48 |

FOREIGN PATENT DOCUMENTS

GB 2159051 A * 11/1985

* cited by examiner

*Primary Examiner* — Steven B McAllister
*Assistant Examiner* — Samantha Miller
(74) *Attorney, Agent, or Firm* — Fitzpatrick, Cella, Harper & Scinto

(57) ABSTRACT

A fire resistant louver system and method of making the same includes a plurality of overlapping louvers mounted in a frame for insertion in a door or wall with the louvers arranged to define a circuitous passage there between that allows air flow from one side to the other of the system. The strips of intumescent material mounted on at least selected ones of the louvers so that when the system is subjected to heat above a predetermined temperature the intumescent material expands to close the circuitous passages.

13 Claims, 3 Drawing Sheets

LOUVER CLOSURE SYSTEM AND METHOD

The present invention relates to louver systems for door and walls, and more particularly, to a system in which an intumescent material is provided on the louvers to seal the circuitous passages therebetween when subjected to a predetermined temperature level.

BACKGROUND OF THE INVENTION

Many privacy doors, walls and other structures are provided with louver systems that allow passage of air from one side to the other without allowing light or visual access therethrough. Such systems by themselves are not fireproof, and when used with fireproof doors and/or fireproof walls, do not satisfy the minimum fire standards established by such organizations as the ASTN, NFPA, or UL. Because of the air passages through them, fire and smoke can rapidly move from one side of the door or wall to the other.

Heretofore attempts have been made to develop fireproof louver systems which meet fire standards. Typically, such systems include louvers which are generally flat and pivotally mounted in a frame biased by springs or weight towards a closed position. These louvers are generally held open against the spring bias or other biasing mechanism, by a so-called fusable link which will melt when subjected to heat, allowing the louvers to close. These systems are relatively complex and expensive to manufacture. In addition, problems can occur with the fusible link that prevent the louvers from closing, thereby rendering the system useless in terms of fireproofing the door or wall in which it is mounted. Another system which has been developed is disclosed in U.S. Pat. No. 6,752,714 to Lorient. In that system, a plurality of fixed slats or louvers are supported in a peripheral frame, with each of the slats being formed of a core of intumescent material coated with a thin layer of aluminum or plastic. In normal operation the slats provide spaces between them which allow air to flow from one side to the other of the louver system in the wall, door or other structure. When the device is subjected to heat the intumescent material expands that material breaking the covering layer and closing off the spaces previously formed by the slats. However, under U.S. fire standards, as established for example by ASTN, NFPA or UL, the requirement for being considered fireproof is that in a standard water test the product tested should remain intact. This requirement appears to be unique to the United States and has been part of the tests required in this country since the 1940's. The system provided by the Lorient patent does not meet fire standard requirements as established by these organizations, because it does not have structural integrity. The intumescent material is not structurally strong and cannot pass the required water pressure tests. Therefore, while it may block smoke, it is not structurally strong and is not fireproof under the established standards.

It is an object of the present invention to provide a louver structure which will meet standard fire code requirements and pass the standard water tests for fire proof systems.

Another object of the present invention is to provide a fireproof louver system which is inexpensive to manufacture.

A still further object of the present invention is to provide a method for retrofitting existing louver systems to render them fireproof in accordance with existing standards.

SUMMARY OF THE INVENTION

In accordance with an aspect of the present invention a louver system is provided with intumescent strips on preselected louvers of the system in order to render the system fireproof. In particular, intumescent strips are secured by a high heat rated pressure sensitive material or by mechanical fastening to each louver or to alternate louvers or other combination of louvers depending on the structure of the louver system. In this arrangement, when the louver system is subjected to heat, such as for example in a fire, the intumescent material will expand and close off the passageways between the louvers. However, because the louvers are structurally sound and formed, preferably, of metal, the intumescent is protected by the louvers and will withstand the standard water pressure tests.

The above, and other objects, features and advantages of this invention will be apparent to those skilled in the art from the following detailed description of illustrative embodiments thereof, which is to be read in connection with the accompanied drawings wherein:

Figure 1:
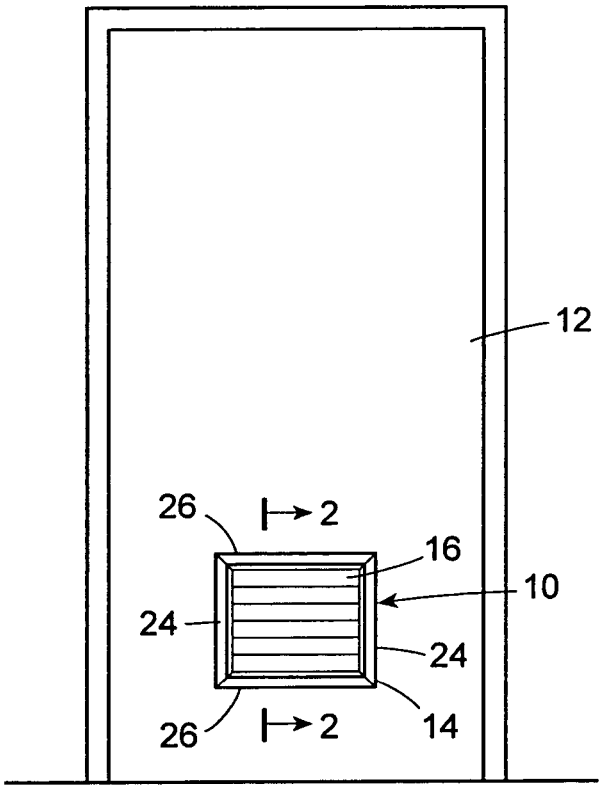
FIG. 1 is an elevational view of a door having a louver system mounted therein in accordance with the present invention.

Referring now to the drawing detail, and initially to FIG. 1, a louver system 10 in accordance with the present invention is shown mounted in a fireproof door 12. The louver system includes a frame 14 and a plurality of louvers 16 mounted therein in any convenient manner.

Figure 2:
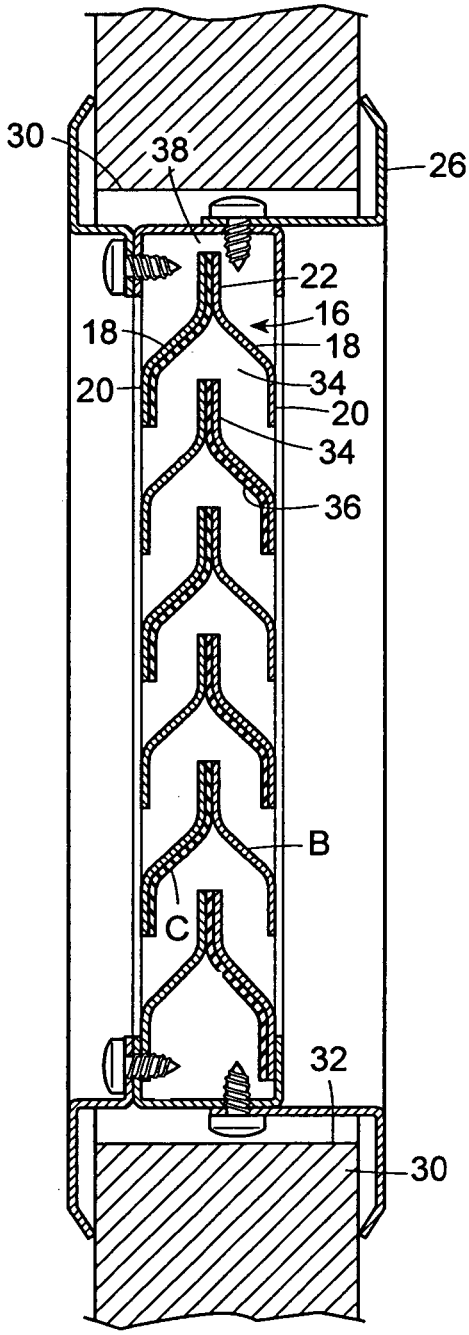
FIG. 2 is a sectional view taken along line 2-2 of FIG. 1 illustrating one embodiment of the louver system and method of the invention.
Figure 4:
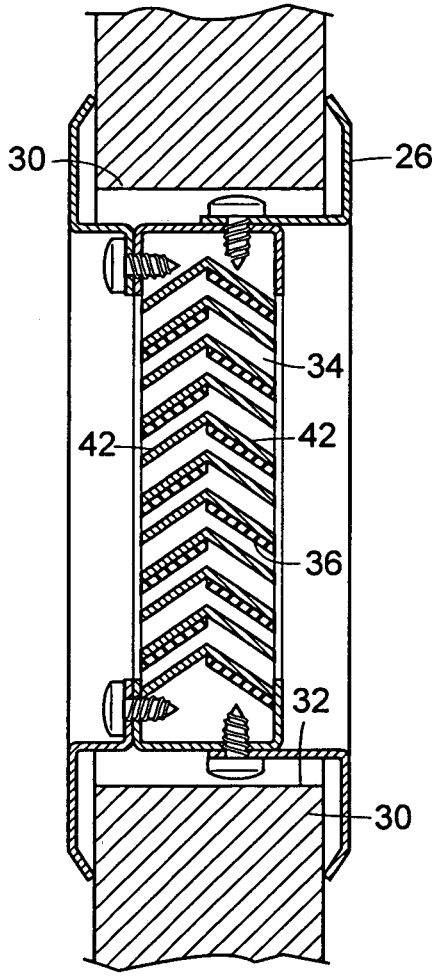
FIG. 4 is sectional view taken along line 4-4 of FIG. 3.

As seen in FIG. 2, the louvers of this embodiment of the invention are generally V-shaped with legs 18 forming the V. The legs 18 additionally include extensions 20, and a stem 22 so that in this embodiment the V generally forms a Y. However, the term V-shaped as used in this specification is intended expressly to cover the Y shape of FIG. 2 as well as the simple V shape illustrated in FIG. 4 as described hereinafter.

In the particular embodiment of FIG. 2 louvers 16 are formed from two strips of metal, such as aluminum or steel, with their stems 22 slightly spaced from one another. The ends of these strips are mounted in the vertical side frame elements 24 of frame 14. They are mounted there in any convenient manner, for example, by simply being seated in complimentary slots in the frame elements 24. The horizontal frame elements 26 of frame 14 are shown in greater detail in FIG. 2 and are secured in any convenient manner to the edges 30 of an opening 32 in the door.

In the embodiment of the invention illustrated in FIG. 2, louvers 16 overlay each other and overlap so that there is no direct passage of light or air from one side of the door to the other. Instead, a circuitous air passage 34 is formed between each adjacent pair of louvers. In this regard, the term circuitous as used herein means any passage which is not straight and does not permit direct viewing from one side of the door to the other.

All illustrated in FIG. 2, selected ones of the louvers include an intumescent material 36 secured to one of their surfaces. Preferably, the intumescent material is formed as a tape like strip having a width of about 1¼ inches and a thickness of about between 0.01 and 0.10 of an inch, preferably about 0.06 of an inch. The strip may be adhered to the louvers by a high heat pressure sensitive material (not shown) on one side of the strip of tape or by mechanical mounting means such as screws, rivets or the like. As illustrated in FIG. 2, the intumescent material extends between the stems 22 of the louver. As also illustrated in FIG. 2, the material is placed on only one leg of each louver, with the leg bearing the intumescent alternating from one side of the frame to the other. By this arrangement, if and when the door is subjected to intense heat, the heat will cause the intumescent material to expand and close off the circuitous passageways 34. In addition, the intumescent will expand outwardly from the space between the stems 22 to aid in closing the passageways including the passageway 38 between the upper most louver and the frame element 26. Of course, if desired, the intumescent strips may be placed on all of the legs of the louver system, or only on the legs on one side.

Figure 3:
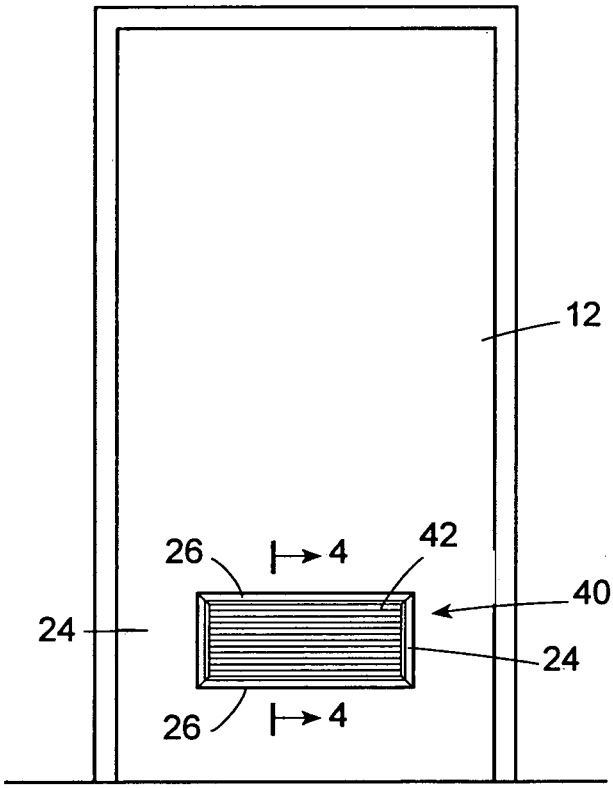
FIG. 3 is elevational view of another louver system in accordance with the present invention.

FIG. 3 is a side view of another louver system 40 formed in accordance with the present invention. In this case, the individual louvers 42 are formed as inverted V-shaped panels, as seen in FIG. 4, again mounted in the side panels 24 of the frame in any convenient manner. The legs of the V-shaped louvers 42 in FIG. 4 may have the intumescent strips applied to them in any desired manner, such as the alternating arrangement of FIG. 2, or on all of the legs of the louvers, or only on the legs of the louvers on one side. In either case, the intumescent material will close off the circuitous passageways 34 between the louvers when subjected to heat.

Figure 5:
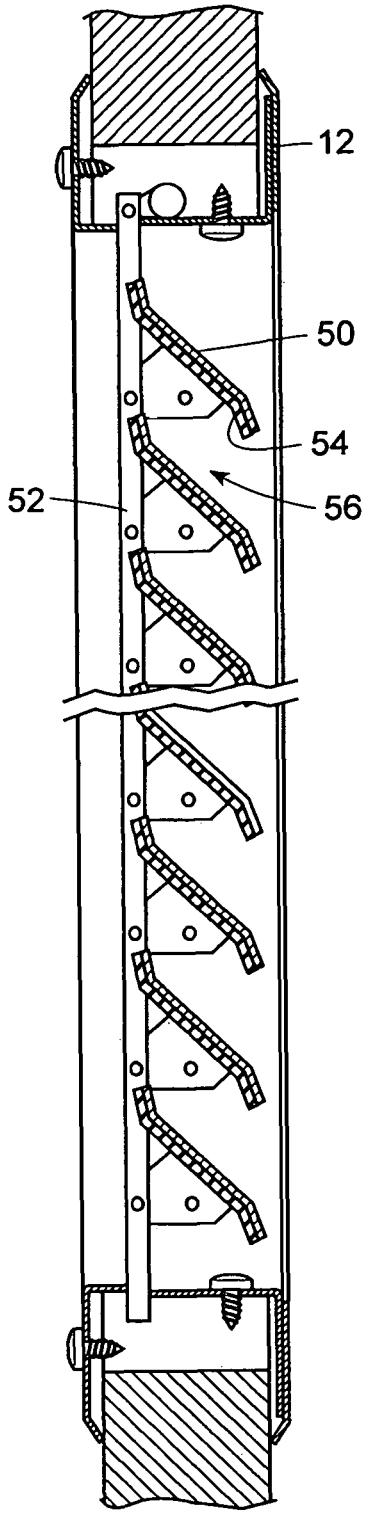
FIG. 5 is a sectional view similar to FIGS. 2 and 4 of another embodiment of the invention.

FIG. 5 illustrates yet another embodiment of the invention in a sectional view similar to FIG. 2. In this case the louvers 50 are simply generally straight louvers inclined downwardly from a main support brace 52 secured in the frame 12. The connection of the louvers to the frame may be made in any known manner as would occur to those skilled in the art. In this embodiment, a strip 54 of intumescent material may be secured to the upper or lower surface of each of the lovers to close the circuitous passageways 56 there between when subjected to heat. This arrangement avoids the complex linkage and spring biasing systems used in the prior art while assuring compliance with the necessary codes to pass the water test they use.

As a result of the present invention, an existing metal non-fire rated louver system with overlapping fins or slats can be made fire rated for use in doors and in fire rated walls.

The intumescent material used in the present invention can be any known intumescent material available in the art. However, it is preferred to use an intumescent material manufactured and sold by Zero International under the trademark INTUMET. The pressure sensitive adhesive used to secure the strips of intumescent material to the louvers also can be any known material as such as some provided by 3M.

Although illustrative embodiments of the present invention have been described here with reference to the accompanied drawings, it is to be understood that various changes and modifications may be affected therein by those skilled in the art without the party from the scope or spirit of this invention.

What is claimed is:

1. A fire resistant louver system comprising a plurality of overlapping aligned and superimposed louvers which allow airflow from one side of the system to the other, said louvers each having a pair of legs, each leg having first and second opposed surfaces respectively spaced from the legs of the louvers immediately adjacent to them, the legs in each louver diverging from each other at an acute angle defining an apex between them to form circuitous passages between the adjacent leg surfaces for said air flow along the leg surfaces and between the spaced legs, and strips of intumescent material mounted on at least the entirety of the first surface of one leg of each of said louvers on alternate louvers on opposite sides of the apexes between the legs of the louver system whereby when said system is subjected to heat above a predetermined temperature said intumescent material expands to contact the second surface of the louver leg opposite the intumescent material to fill the spaces between said legs to close said circuitous passages.

2. A fire resistant louver system as defined in claim 1 wherein said intumescent material is in the form of a strip of tape secured to said one leg of each of said louvers.

3. A fire resistant louver system as defined in claim 2 wherein said intumescent material strips are secured to the louvers by high heat pressure sensitive material.

4. A fire resistant louver system as defined in claim 2 including means for mechanically securing said intumescent strips to said louvers.

5. A fire resistant louver system as defined in claim 1 wherein said louvers are formed of metal.

6. A fire resistant louver system as defined in claim 5 wherein the diverging legs of said louvers form a V shape and the legs of the V shape overlap to define said circuitous passages and prevent light passage directly therethrough.

7. A fire resistant louver system as defined in claim 6 wherein said louvers include a stem section at the apex of the V shape defined by said diverging legs to provide a third leg extending into but not blocking air flow in the space between the diverging legs of a louver adjacent thereto.

8. A fire resistant louver system as defined in claim 7 wherein said louvers are formed of two mirror image sections with a space between the third legs of the mirror image sections and with said intumescent material extending into said space.

9. A method for making fireproof an air vent louver system formed of a plurality of overlapping louvers arranged to define circuitous passages therebetween which allow airflow from one side to the other of such system including the steps of forming each of said louvers with a pair of diverging legs having first and second opposed sides, positioning said louvers in alignment to overlay each other in spaced relationship with respect to the legs of the louvers immediately adjacent to them such that the sides of said diverging legs overlap to define circuitous passages between the adjacent leg surfaces for air flow along the leg surfaces and between the spaced legs that prevents light passage directly therethrough, and mounting strips of intumescent material on at least the entirety of the first side of one leg of each of said louvers on alternate louvers on opposite sides of the louver system whereby when said system is subjected to heat above a predetermined temperature said material expands to contact the second surface of the louver leg opposite the intumescent material to close said circuitous passages.

10. A method for making fireproof an air vent louver system as defined in claim 9, including the step of forming said intumescent strips as tape like strips.

11. A method as defined in claim 10, including the step of using a high heat pressure sensitive material to secure said strips of tape to said selected louvers.

12. A method as defined in claim 10, including the step of using mechanical means for securing said strips of tape to said selected louvers.

13. A fire resistant louver system as defined in claim 6 wherein each of said diverging legs of said louvers has a free end opposite and spaced from its associated apex which includes a leg extension which lies in a plane parallel to the plane of said stem section, said leg extensions of the legs having intumescent material mounted on their surfaces facing the stem of a louver therebelow to fill the space between the extensions and the stems when the intumescent material is subject to heat above a predetermined temperature.

* * * * *